US006409234B1

(12) United States Patent
Larsen et al.

(10) Patent No.: US 6,409,234 B1
(45) Date of Patent: Jun. 25, 2002

(54) LATCH ASSEMBLY FOR A MOVABLE CLOSURE

(75) Inventors: Marvin L. Larsen; Kevin P. Eschweiler, both of New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/438,690

(22) Filed: Nov. 12, 1999

(51) Int. Cl.[7] ..... E05C 1/12

(52) U.S. Cl. ..... 292/173; 292/DIG. 31; 292/336.3

(58) Field of Search ..... 292/173, 336.3, 292/DIG. 31, DIG. 30

(56) References Cited

U.S. PATENT DOCUMENTS 1,964,556 A * 6/1934 Bittorf ..... 292/173
2,763,503 A * 9/1956 Tasch ..... 292/173
3,189,937 A * 6/1965 Sciortino ..... 16/114
3,576,118 A * 4/1971 Doerrfeld ..... 292/173
4,127,915 A * 12/1978 Logan ..... 16/114 R
4,343,501 A * 8/1982 Meeks ..... 292/336.3
4,412,696 A * 11/1983 Ishii ..... 292/336.3
4,497,514 A * 2/1985 Moriya ..... 292/336.3
4,681,357 A * 7/1987 Uemura ..... 292/336.3
4,818,003 A * 4/1989 Seko ..... 292/336.3
5,325,597 A * 7/1994 Clifton ..... 30/514
5,927,773 A * 7/1999 Larsen ..... 292/337

* cited by examiner

*Primary Examiner*—Gary Estremsky
(74) *Attorney, Agent, or Firm*—Wood, Phillips, Katz, Clark & Mortimer

(57) ABSTRACT

A latch assembly for a movable closure. The latch assembly has a housing with a front, a rear, and a first wall with a forwardly facing surface and an opening through the first wall. The latch assembly further has an actuating assembly including a paddle that is pivotably mounted for movement relative to the housing about a first axis between first and second positions. The paddle has a second wall with a rearwardly facing surface. The actuating assembly further has a post projecting rearwardly from the second wall into the opening through the first wall. The post has a third wall which fully blocks the opening through the first wall as viewed from the front of the latch assembly with the paddle in the first position.

19 Claims, 4 Drawing Sheets

LATCH ASSEMBLY FOR A MOVABLE CLOSURE

BACKGROUND OF THE INVENTION

1. Field of the Invention

This invention relates to latch assemblies of the type used to releasably maintain a movable closure in a closed state.

2. Background Art

Paddle-operated latch assemblies are well known in the prior art. One exemplary latch assembly is shown in U.S. Pat. No. 5,042,853, to Gleason et al. This type of latch assembly is useable in closures in a wide range of environments, for example, on recreational vehicles, trailers, motor homes, tool boxes, etc. In a typical installation, an opening is provided through the closure to accept the latch assembly. The latch assembly may extend fully through the opening to engage either a) an operating linkage to effect locking, as in the case of a tool box, or b) an operating assembly that may include a paddle on the inside, as in the case of a door on a recreational vehicle. In the latter environment, it is known to provide a cup-shaped housing defining a receptacle within which an external paddle resides and to operatively engage the paddle with a latch element behind the housing through an opening in the housing. Typically, this opening will be provided in a wall having a forwardly facing surface at the base of the cup-shaped receptacle. This opening potentially permits ingress of rain and other foreign material through the front oft he latch assembly housing. This opening provides an unimpeded path for windblown rain, dust, and the like, at the front of the latch assembly to between the front and rear walls of the closure and/or to the interior of the space bounded by the closure. The ongoing migration of water through this opening may eventually foul the latch mechanism and/or cause damage to the closure, such as rotting or delamination. Significant ingress of water to the interior space bounded by the closure may cause damage to the contents within that space.

One solution to this problem is disclosed in U.S. Pat. No. 5,927,773 which is assigned to the assignee herein and incorporated herein by reference. A structure is shown therein wherein a paddle has an actuating post extending through the housing, which post is spaced from the peripheral edge of the paddle wall so that the paddle wall fully blocks the housing opening as viewed from the front of the latch assembly.

Typically, the paddles have a flat, rearwardly facing surface that is engageable simultaneously by a plurality of fingers on a user's hand that is grasping the paddle. It is known to form a series of U-shaped seats for fingers on an edge of the paddle that is grasped. These receptacles appear to act primarily as finger locators and do not seat any appreciable length of a user's fingers as might contribute significantly to comfort in use.

SUMMARY OF THE INVENTION

In one form of the invention, a latch assembly is provided for a movable closure. The latch assembly has a housing with a front, a rear, and a first wall with a forwardly facing surface and an opening through the first wall. The latch assembly further has an actuating assembly including a paddle that is pivotably mounted for movement relative to the housing about a first axis between first and second positions. The paddle has a second wall with a rearwardly facing surface. The actuating assembly further has a post projecting rearwardly from the second wall into the opening through the first wall. The post has a third wall which fully blocks the opening through the first wall as viewed from the front of the latch assembly with the paddle in the first position.

In one form, there is a surface on the third wall that is substantially flat and faces rearwardly with the paddle in the first position.

The third wall may be directly exposed to the first wall with the paddle in the first position.

The third wall may abut directly to the first wall with the paddle in the first position.

In one form, a single piece on the post extends from the second wall and into the opening through the first wall.

In one form, the third wall has an exposed flat surface facing rearwardly with the paddle in the first position and having a first area. The post has a cross-sectional area, taken orthogonally to a fore-and-aft line with the paddle in the first position at a location between the flat surface oft he third wall and the rearwardly facing surface of the second wall, that is less than the first area.

In one form, the post has a cross-sectional area taken orthogonally to a fore-and-aft line with the paddle in the first position and the cross-sectional area of the post decreases progressively over at least a portion of the post between the flat surface of the third wall and the rearwardly facing surface of the second wall.

In one form, the paddle has a portion that is graspable by a hand of a user to be drawn forwardly by a user to change the paddle from the first position to the second position, with the paddle having a concave surface against which a finger on the hand of a user that is grasping the graspable portion can bear.

In one form, there is one piece that defines the post and at least a part of the second wall on the paddle.

In one form, there is a peripheral edge around the flat surface on the third wall and the post has a portion which projects from the flat surface on the third wall. The post portion is spaced from the peripheral edge around the flat surface on the third wall so that the flat surface on the third wall extends fully around the post portion and the post portion projects into the opening through the first wall with the paddle in the first position.

The housing may have a forwardly opening, cup-shaped receptacle, with the paddle residing within the receptacle with the paddle in the first position.

In one form, the second wall has a width taken orthogonally to the first axis and there is concave receptacle on the rearwardly facing surface of the second wall that extends at least one-third the width of the second wall for receiving a finger on a hand of a user grasping the hand-graspable portion of the paddle.

In one form, the surface on the third wall has a first area and the opening through the first wall has a second area as viewed from the front of the latch assembly and the first area is greater than the second area.

In one form, the latch assembly further includes a latch element that is movable between a latched position and a released position and the post drives the latch element from one of the latched and released position into the other of the latched and released position as an incident of the paddle moving from the first position into the second position.

The invention is also directed to a latch assembly having a housing with a front, a rear, and a first wall with a forwardly facing surface and an opening through the first wall. The latch assembly further has an actuating assembly with a paddle that is pivotably mounted for movement relative to the housing about a first axis between first and second positions. The paddle has a second wall with a rearwardly facing surface. The actuator assembly further has a post projecting rearwardly from the second wall into the opening through the first wall and having a third wall. The third wall has an exposed flat surface facing rearwardly with the paddle in the first position and having a first area and the post has a cross-sectional area, taken orthogonally to a fore-and-aft line with the paddle in the first position at a location between the flat surface on the third wall and the rearwardly facing surface of the second wall, that is less than the first area.

DETAILED DESCRIPTION OF THE DRAWINGS

Figure 2:
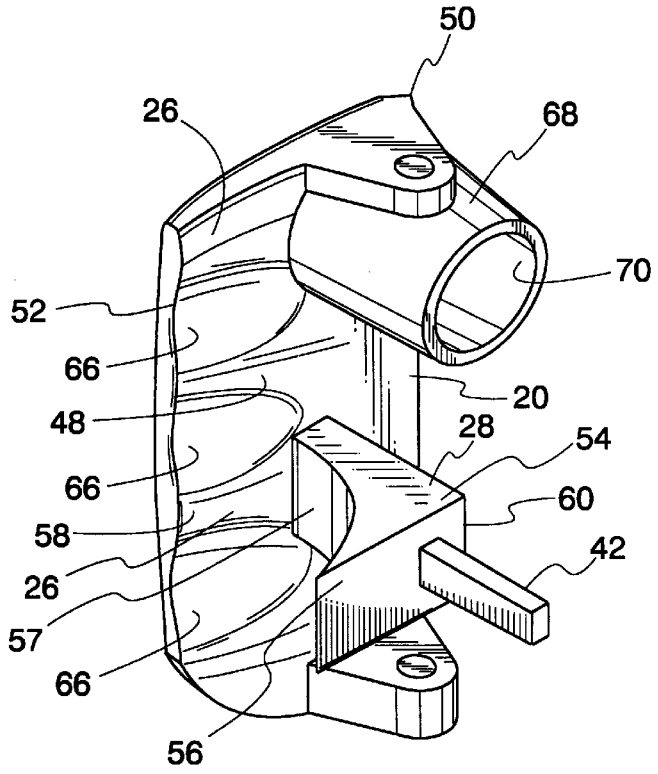
FIG. 2 is an enlarged, rear perspective view of the paddle in FIG. 1.
Figure 1:
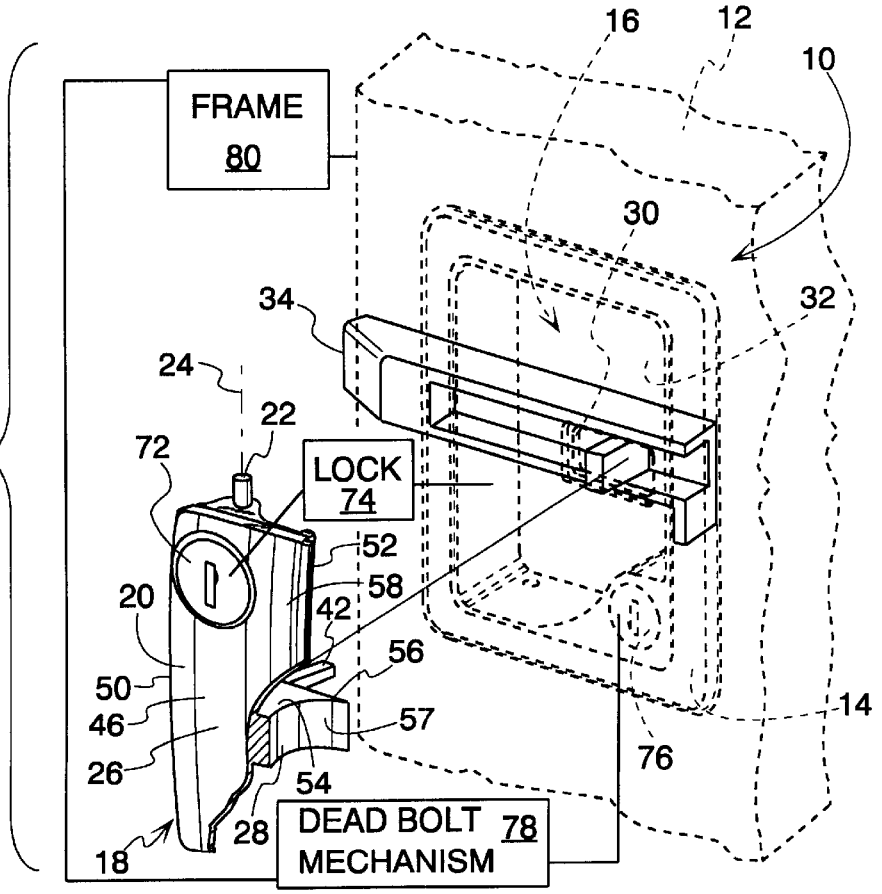
FIG. 1 is a perspective view of a latch assembly, according to the present invention, operatively connected to a closure element and with a paddle on the latch assembly separated therefrom.
Figure 3:
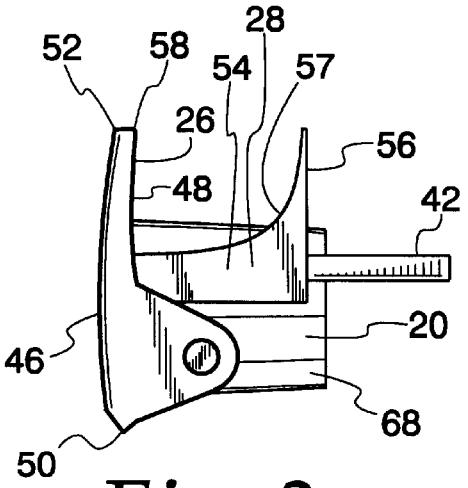
FIG. 3 is an enlarged, bottom view of the paddle in FIGS. 1 and 2.
Figure 4:
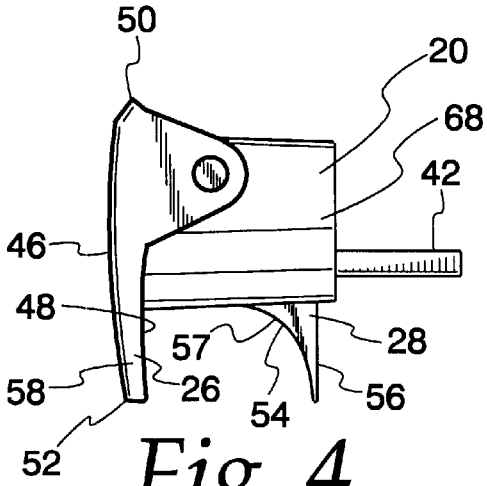
FIG. 4 is an enlarged, plan view of the paddle in FIGS. 1–3.
Figure 5:
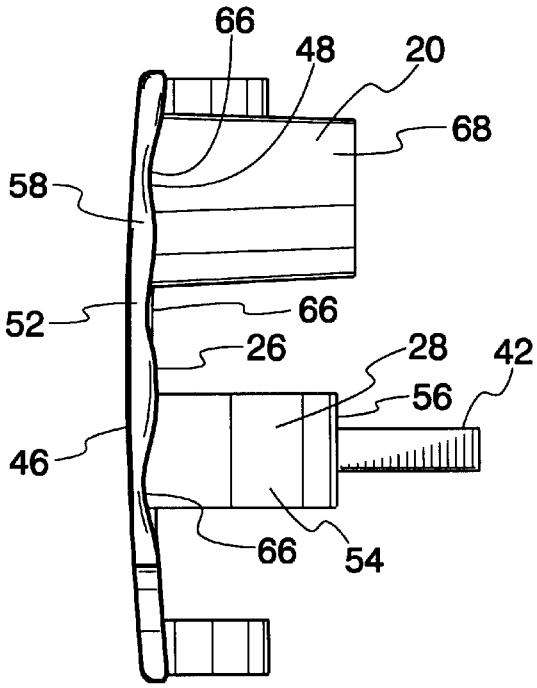
FIG. 5 is an enlarged, side elevation view of the paddle in FIGS. 1–4.
Figure 6:
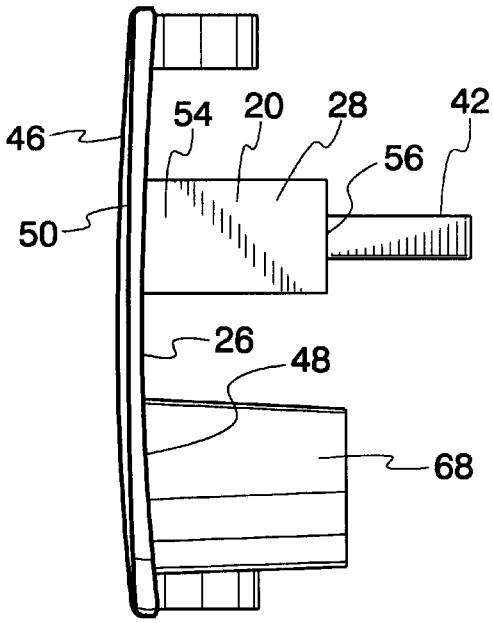
FIG. 6 is an enlarged, elevation view of the paddle in FIGS. 1–5 taken from the side opposite that in FIG. 5.

In FIGS. 1–12, a latch assembly, according to the present invention, is shown at 10. The latch assembly 10 is shown in FIG. 1 operatively connected to a movable closure element 12, which may be a pivotably mounted access door, or the like.

The latch assembly 10 consists of a housing 14 which has a forwardly opening, cup-shaped receptacle 16. An actuating assembly at 18 is provided on the housing 14 and consists of a paddle 20 mounted through spaced, coaxial pins 22 (one shown) for pivoting movement relative to the housing 14 about an axis 24. The paddle 20 is pivotable between a first position, shown in FIGS. 7, 9, and 11, and a second position, shown in FIGS. 8, 10, and 12.

The paddle 20 has a first wall 26 from which a post 28 projects rearwardly in cantilever fashion. The post 28 projects through an opening 30 through a rear wall 32 of the housing 14 to engage a latch element 34 behind the rear wall 32. The latch element 34 in this embodiment is a sliding bolt which is movable between a latched position, shown in FIGS. 7 and 9, and a released position, shown in FIGS. 8 and 10. The latch element 34 is translatable guidingly relative to the housing 14 between the latched and released positions. A spring 36 acts between a shoulder 38 on the housing 14 and a facing shoulder 40 on the latch element 34 to normally bias the latch element 34 into the latched position. The post 28 has a free end portion 42 which engages a shoulder 44 on the latch element 34 and drives the latch element 34 against the force of the spring 36 from the latched position into the released position as an incident of the paddle 20 moving from the first position into the second position. Releasing the paddle 20 in the second position allows the spring 36 to drive the latch element 34 back into the latched position. As this occurs, the latch element 34 acts against the free end portion 42 of the post 28 to move the paddle 20 from the second position into the first position.

The first paddle wall 26 has an exposed, forwardly facing surface 46 and a rearwardly facing surface 48 from which the post 28 projects. The post 28 projects from the first wall 26 approximately midway between edges 50, 52 between which a width dimension (W) of the paddle 20 is defined.

The post 28 has a base portion/wall 54 which has a cross-sectional area taken orthogonally to a fore-and-aft line L (FIG. 7) that increases progressively from the rearwardly facing wall surface 48 to a rearwardly facing surface 56 at the rear of the base portion/wall 54. The free end portion 42 of the post 28 projects in cantilever fashion rearwardly from the surface 56.

Figure 7:
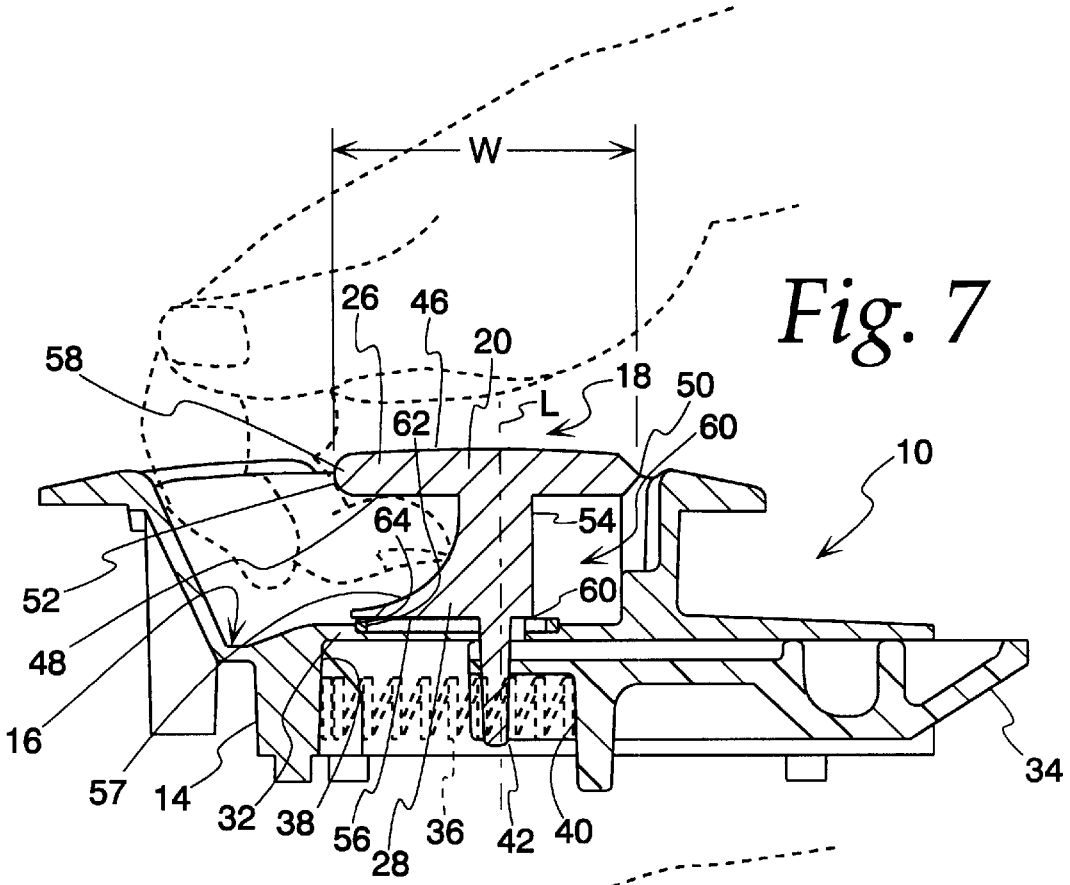
FIG. 7 is an enlarged, cross-sectional view of the inventive latch assembly with the paddle in a first position.
Figure 8:
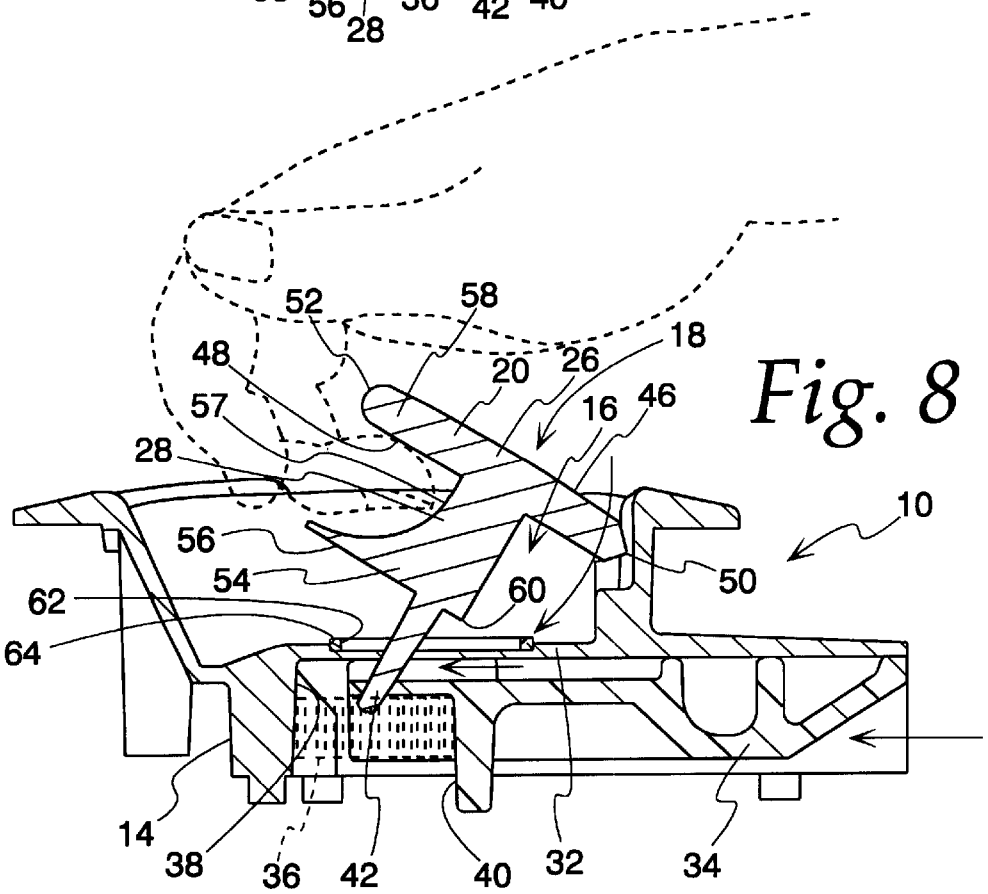
FIG. 8 is a view as in FIG. 7 with the paddle moved to a second position.
Figure 9:
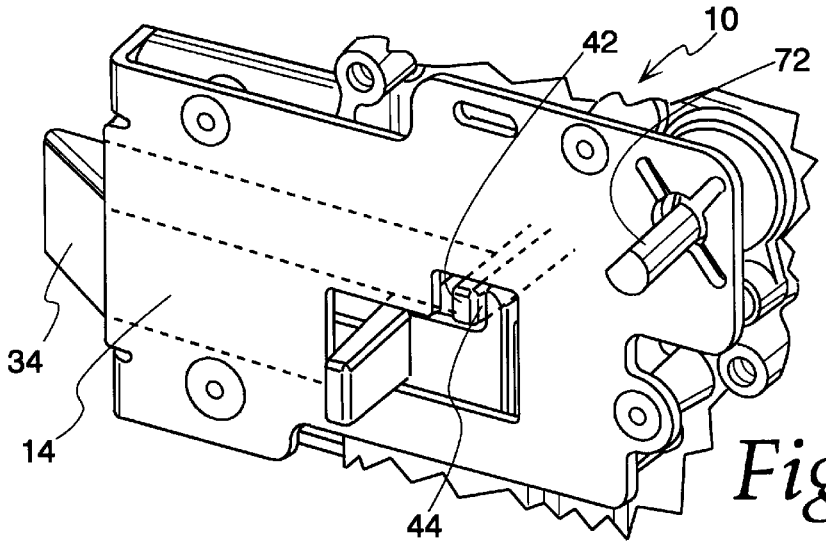
FIG. 9 is an enlarged, fragmentary, rear perspective view of the inventive latch assembly in FIGS. 1–7 with the paddle in the first position.
Figure 10:
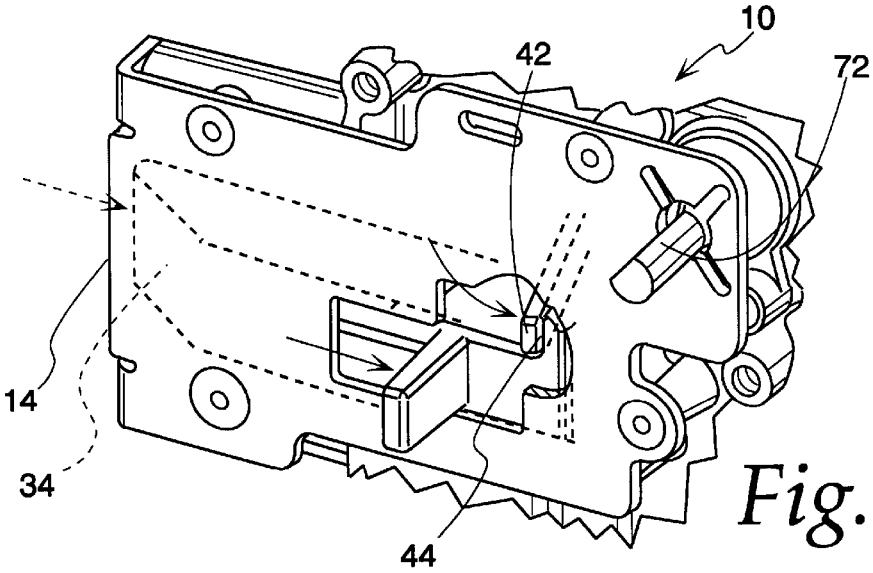
FIG. 10 is a view as in FIG. 9 with the paddle moved into the second position.

The base portion/wall 54 has a concave surface 57 underneath a portion 58 of the paddle 20 that is graspable by the hand of a user, as shown in FIGS. 7 and 8, at the edge 52, which is substantially straight and extends generally parallel to the pivot axis 24 to allow the paddle portion 58 to be drawn forwardly to pivot the paddle 20 from the first position into the second position. The surface 57 is continuous and uninterrupted over the axial dimension of the post 28 parallel to the pivot axis 24. The surface 57 and surface 48 cooperatively define a comfortable receptacle for at least one finger on the hand of a user with the hand grasping the paddle 20, as shown in FIGS. 7 and 8. This allows a sturdy post configuration to be mounted mid-width of the paddle 20 without interfering with the user's grasping and operation of the paddle 20.

The free end portion 42 of the post 28 projects from the surface 56 at a location within the peripheral edge 60 extending fully around the surface 56. Accordingly, the surface 56 extends fully around the free end portion 42.

The surface 56 has an area that is substantially larger than the area of the opening 30 as viewed from the front of the latch assembly 10. The paddle 20 is preferably mounted so that the surface 56 fully covers the opening 30 as viewed from the front of the latch assembly 10.

Figure 11:
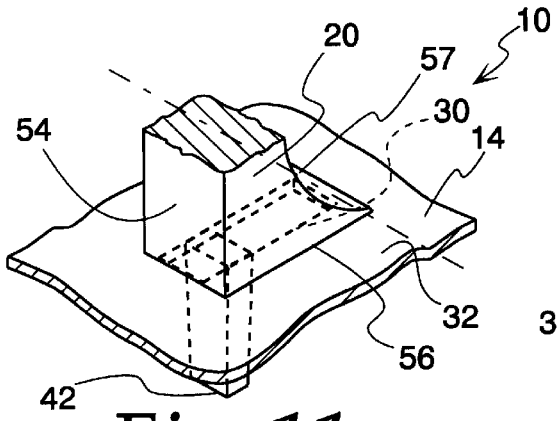
FIG. 11 is an enlarged, fragmentary, front perspective view showing the cooperation between a post on the paddle on the inventive latch assembly of FIGS. 1–10 with the paddle in the first position.
Figure 12:
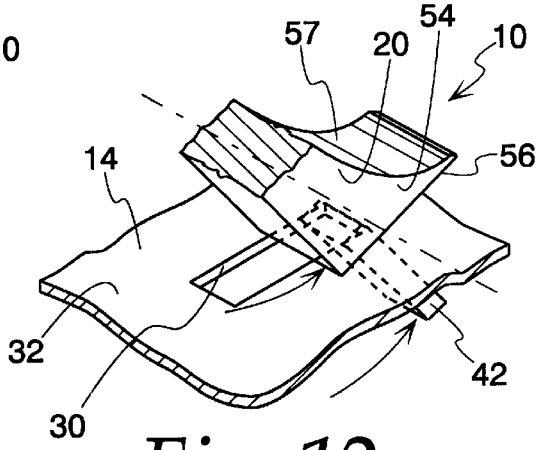
FIG. 12 is a view as in FIG. 11 with the paddle in the second position.

The surface 56 is directly exposed to the rear housing wall 32. In the embodiment shown, a gasket 62 surrounds the opening 30 and nests in a framing undercut 64. The gasket 62 becomes compressed between the post surface 56 and the rear housing wall 32 to make a positive seal between the post 28 and housing 14 around the opening 30. However, it is contemplated that the gasket 62 and undercut 64 could be eliminated, as shown in FIGS. 11 and 12, and that the surface 56 could thereby abut directly to the rear wall surface 32 to block the opening 30.

In one form, the rear wall 32 and the entire post 28 are formed as one piece. While this is preferred, the post 28 could be formed in multiple parts and separately from the paddle wall 26.

To add to user comfort, a series of concave receptacles 66 are formed in the rearwardly facing surface 48 of the paddle 22. The user's fingers grasping the graspable portion 58 of the paddle 20 nest in these receptacles 66. In a preferred form, the receptacles 66 extend from the edge 52 a distance equal to at least one third, and more preferably, at least one-half, of the width W.

A cylindrical base 68 is formed on the paddle 20 to define a receptacle 70 for a lock cylinder 72 to operate a conventional type lock 74 with a key. The lock 74 may have a pivotable latch element which engages the housing 14 to preclude movement of the paddle 20 from the first position into the second position, with the lock 74 in a locked state.

An optional lock cylinder 76 may be provided on the housing 14 to operate a deadbolt mechanism 78 having an element which extends into a frame 80 upon which the closure element 12 is mounted.

The foregoing disclosure of specific embodiments is intended to be illustrative of the broad concepts comprehended by the invention.

We claim:

1. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which is substantially planar and overlays the full opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and uninterrupted over the axial dimension of the post to receive at least one finger on the hand of a user grasping the graspable portion of the paddle with the hand of the user against the straight edge and the paddle in each of the first and second positions.

2. The latch assembly according to claim 1 wherein the third wall is directly exposed to the first wall with the paddle in the first position.

3. The latch assembly according to claim 2 wherein the third wall directly abuts to the first wall with the paddle in the first position.

4. The latch assembly according to claim 1 wherein there is a single piece defining the post that extends from the second wall and into the opening through the first wall.

5. The latch assembly according to claim 1 wherein there is one piece that defines the post and at least a part of the second wall.

6. The latch assembly according to claim 1 wherein there is a substantially flat surface on the third wall and a peripheral edge around the flat surface on the third wall, and the post has a portion which projects from the flat surface on the third wall, the post portion being spaced from the peripheral edge around the flat surface on the third wall so that the flat surface on the third wall extends fully around the post portion and the post portion projects into the opening through the first wall with the paddle in the first position.

7. The latch assembly according to claim 1 wherein the second wall has a width taken orthogonally to the first axis and there is a concave receptacle on the rearwardly facing surface of the second wall that extends at least one third the width of the second wall for receiving a finger on a hand of a user grasping the graspable portion of the paddle.

8. The latch assembly according to claim 1 wherein the latch assembly further comprises a latch element that is movable between a latched position and a released position and the post drives the latch element from one of the latched and released positions into the other of the latched and released positions as an incident of the paddle moving from the first position into the second position.

9. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which fully blocks the opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and uninterrupted over the axial dimension of the post to receive at least one finger on the hand of a user grasping the graspable portion of the paddle with the hand of the user against the straight edge, wherein there is a surface on the third wall that is substantially flat and faces rearwardly with the paddle in the first position.

10. The latch assembly according to claim 9 wherein the surface on the third wall has a first area, the opening through the first wall has a second area as viewed from the front of the latch assembly and the first area is greater than the second area.

11. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which fully blocks the opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and unintermupted over the axial dimension of the post to receive at least one finger on the hand of a user grasping the graspable portion of the paddle with the hand of the user against the straight edge, wherein the third wall has an exposed flat surface facing rearwardly with the paddle in the first position and having a first area and the post has a solid cross-sectional area taken orthogonally to a fore and aft line with the paddle in the first position at a location between the flat surface of the third wall and the rearwardly facing surface of the second wall that is less than the first area.

12. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which fully blocks the opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and uninterrupted over the axial dimension of the post to receive at least one finger on the hand of a user grasping the graspable portion of the paddle with the hand of the user against the straight edge, wherein the third wall has an exposed flat surface facing rearwardly with the paddle in the first position, the post has a solid cross-sectional area taken orthogonally to a fore and aft line with the paddle in the first position and the cross-sectional area of the post decreases progressively over at least a portion of the post between the flat surface of the third wall and the rearwardly facing surface of the second wall.

13. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which fully blocks the opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and uninterrupted over the axial dimension of the post to receive at least one finger on the hand of a user grasping the graspable portion of the paddle with the hand of the user against the straight edge, wherein the housing has a forwardly opening cup-shaped receptacle and the paddle resides within the receptacle with the paddle in the first position.

14. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a substantially straight edge extending generally parallel to the first axis over a substantial dimension of the paddle and a second wall with a rearwardly facing surface, wherein the actuating assembly further comprises a post projecting rearwardly from the second wall into the opening through the first wall, wherein the post has a third wall which fully blocks the opening through the first wall as viewed from the front of the latch assembly with the paddle in the first position, wherein the post has an axial dimension parallel to the first axis;

wherein the paddle has a portion that is graspable by a hand of a user with the hand of the user against the straight edge to be drawn forwardly to change the paddle from the first position into the second position, wherein the post has a concave surface that is substantially continuous and uninterrupted over the axial dimension of the post to receive at least one finger on the hand of a user grasping the graspable portion of the paddle with the hand of the user against the straight edge, wherein the second wall has a width taken orthogonally to the first axis and there is a concave receptacle on the rearwardly facing surface of the second wall that extends at least one third the width of the second wall for receiving a finger on a hand of a user grasping the graspable portion of the paddle, wherein there are a plurality of concave receptacles on the rearwardly facing surface of the second wall that open rearwardly and each extend at least one-third the width of the second wall for receiving a finger on a hand of a user grasping the graspable portion of the handle.

15. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a second wall with a rearwardly facing surface, wherein the actuating assembly further comprises a post projecting rearwardly from the second wall into the opening through the first wall and having a third wall, wherein the third wall has an exposed flat surface facing rearwardly with the paddle in the first position and having a first area and the post has a cross-sectional area taken orthogonally to a fore and aft line with the paddle in the first position at a location between the flat surface on the third wall and the rearwardly facing surface of the second wall that is less than the first area, wherein the second wall has a width taken orthogonally to the first axis and there are a plurality of concave receptacles on the rearwardly facing surface of the second wall that open rearwardly and extend at least one third the width of the second wall each for receiving a finger on a hand of a user grasping the graspable portion of the paddle.

16. The latch assembly according to claim 15 wherein the paddle has a portion that is graspable by a hand of a user to be drawn forwardly by a user to change the paddle from the first position into the second position and the post has a concave surface against which a finger on the hand of a user that is grasping the graspable portion can bear.

17. The latch assembly according to claim 15 wherein there is one piece that defines the post and at least a part of the second wall.

18. The latch assembly according to claim 15 wherein there is a peripheral edge around the flat surface on the third wall, and the post has a portion which projects from the flat surface on the third wall, the post portion being spaced from the peripheral edge around the flat surface on the third wall so that the flat surface on the third wall extends fully around the post portion and the post portion projects into the opening in the first wall with the paddle in the first position.

19. A latch assembly for a movable closure, the latch assembly comprising:

a housing having a front, a rear, and a first wall with a forwardly facing surface and an opening through the first wall; and an actuating assembly comprising a paddle that is pivotably mounted for movement relative to the housing about a first axis between first and second positions, the paddle having a second wall with a rearwardly facing surface, wherein the actuating assembly further comprises a post projecting rearwardly from the second wall into the opening through the first wall and having a third wall, wherein the third wall has an exposed flat surface facing rearwardly with the paddle in the first position and having a first area and the post has a cross-sectional area taken orthogonally to a fore and aft line with the paddle in the first position at a location between the flat surface on the third wall and the rearwardly facing surface of the second wall that is less than the first area, wherein the second wall has a width taken orthogonally to the first axis and there are a plurality of concave receptacles on the rearwardly facing surface of the second wall that open rearwardly and extend at least one third the width of the second wall each for receiving a finger on a hand of a user grasping the graspable portion of the paddle, wherein the post has a solid cross-sectional area taken orthogonally to a fore and aft line with the paddle in the first position and the cross-sectional area of the post decreases progressively over at least a portion of the post between the flat surface on the third wall and the rearwardly facing surface of the second wall.

* * * * *